US010369394B2

(12) United States Patent
Bowen

(10) Patent No.: US 10,369,394 B2
(45) Date of Patent: Aug. 6, 2019

(54) USE OF HIGH MOLECULAR WEIGHT ACRYLIC POLYMERS IN FIRE FIGHTING FOAMS

(71) Applicant: Tyco Fire Products LP, Lansdale, PA (US)

(72) Inventor: Martina E. Bowen, Marinette, WI (US)

(73) Assignee: Tyco Fire Products LP, Lansdale, PA (US)

( * ) Notice: Subject to any disclaimer, the term of this patent is extended or adjusted under 35 U.S.C. 154(b) by 543 days.

(21) Appl. No.: 14/775,607

(22) PCT Filed: Mar. 14, 2014

(86) PCT No.: PCT/US2014/029338
§ 371 (c)(1),
(2) Date: Sep. 11, 2015

(87) PCT Pub. No.: WO2014/153154
PCT Pub. Date: Sep. 25, 2014

(65) Prior Publication Data

US 2016/0023032 A1 Jan. 28, 2016

Related U.S. Application Data

(60) Provisional application No. 61/786,267, filed on Mar. 14, 2013.

(51) Int. Cl.
*A62D 1/02* (2006.01)
*A62D 1/00* (2006.01)

(52) U.S. Cl.
CPC ..... *A62D 1/0071* (2013.01); *A62D 1/0035* (2013.01); *A62D 1/0042* (2013.01)

(58) Field of Classification Search
CPC ... A62D 1/0071; A62D 1/0042; A62D 1/0035
See application file for complete search history.

(56) References Cited

U.S. PATENT DOCUMENTS 3,404,089 A * 10/1968 Holzinger ..... A62D 1/0042 252/2
4,060,132 A * 11/1977 Chiesa, Jr. ..... A62C 99/0036 169/46
2011/0240309 A1* 10/2011 Kingma ..... A62D 1/005 166/369

FOREIGN PATENT DOCUMENTS

EP 0 595 772 A1 4/1994
WO WO 2011/050980 A2 5/2011

OTHER PUBLICATIONS

International Search Report and Written Opinion, International Application No. PCT/US2014/029338 (published as WO 2014/153154) (dated Jul. 15, 2014).

* cited by examiner

*Primary Examiner* — Peter F Godenschwager
*Assistant Examiner* — Andrew J. Oyer
(74) *Attorney, Agent, or Firm* — Foley & Lardner LLP

(57) ABSTRACT

Aqueous firefighting composition concentrates are provided that contain an effective amount of a high molecular weight water soluble anionic acrylic polymer, an effective amount of at least one high molecular weight polysaccharide gum; and an effective amount of at least one surfactant. In the present context, a high molecular weight water-soluble anionic acrylic polymer is a polymer with an average molecular weight $M_w$ of at least one million (1000 kDa). The combination of the acrylic polymer and the gum provide a concentrate that generates foam with highly desirable fire-fighting properties, including high foam expansion ratio, long burnback time, and slow drainage time while avoiding problems with previous gum-containing foam concentrates, such as high viscosity and component separation upon storage.

20 Claims, No Drawings

USE OF HIGH MOLECULAR WEIGHT ACRYLIC POLYMERS IN FIRE FIGHTING FOAMS

PRIORITY DATA

This application is a 35 U.S.C. § 371 application of International Application No. PCT/US2014/029338, filed Mar. 14, 2014, which claims the benefit of U.S. Provisional Patent Application No. 61/786,267, filed Mar. 14, 2013, each of which application is incorporated herein by reference in its entirety.

BACKGROUND

The use of organofluorine compounds is widespread in fire foams. Fluorosurfactants increase the extinguishing capacity of the foams, especially on liquid and water-immiscible substances. Typically, fire fighting foams are prepared from aqueous concentrates which are diluted with water and foamed using a mechanical device. Typically, for the foam to remain stable during the extinguishing operation, a thickener, preferably a polysaccharide, is added to the concentrate. The presence of the thickener can cause the concentrate to be so thick that the concentrate is difficult to pump efficiently, and therefore can cause proportioning problems during foam generation and application. It can also cause problems with the stability of the concentrate, since the thickener often is found to separate from the concentrate upon storage, especially at elevated temperatures.

Until recently, aqueous film forming foams that were used for fire fighting invariably contained low molecular weight fluorosurfactants and fluoropolymer surfactants having perfluoroalkyl chains where the perfluoroalkyl group was at least a perfluorooctyl group. For example, it was believed that a surfactant required at least a perfluorooctyl moiety to provide the necessary physicochemical attributes for efficient and persistent foam formation for fire fighting applications. See WO03/049813. However, perfluorooctyl moieties have been shown to be environmentally persistent and to accumulate in the livers of test animals, leading to calls for the phase-out of materials, including foam components, containing a perfluorooctyl group. Recent regulatory efforts such as the United States EPA's PFOA Stewardship Program and EC directives pertaining to telomer-based higher homologue perfluorinated surfactants have sought to discourage use of perfluorooctyl-containing components and, ideally to remove fluorosurfactants from foam concentrates completely.

However, preparation of fluorine-free foam extinguishants which reliably achieve the highest firefighting performance, and that are stable on storage remains problematic.

SUMMARY OF THE INVENTION

Aqueous firefighting composition concentrates are provided, containing an effective amount of a high molecular weight water soluble anionic acrylic, an effective amount of at least one high molecular weight polysaccharide gum; and an effective amount of at least one surfactant. The surfactant may be a non-fluorinated surfactant and the composition advantageously is substantially free of any organofluorine compounds. Alternatively the surfactant may be a fluorinated surfactant. In certain embodiments, the polymer may have a molecular weight of at least about 1500 kDa or at least about 2000 kDa. Advantageously, the polymer is polyacrylamidomethylpropane sulfonic acid. The high molecular weight polysaccharide gum may be a galactomannan gum and/or a xanthan gum. Advantageously, the concentrate contains at least one galactomannan gum and at least one xanthan gum.

The concentrate may further contain a solvent. The solvent may be, for example, propylene glycol, ethylene glycol, and/or butylcarbitol.

In certain embodiments, the at least one surfactant is an anionic surfactant, a zwitterionic surfactant, and/or a nonionic surfactant. The concentrate may contain at least two surfactants selected from the group consisting of anionic surfactants, zwitterionic surfactants and nonionic surfactants. In other embodiments, the concentrate contains at least one anionic surfactant, at least one zwitterionic surfactant and at least one nonionic surfactant.

Also provided are aqueous firefighting composition concentrates, containing an effective amount of high molecular weight polyacrylamidomethylpropane sulfonic acid, a galactomannan gum, a xanthan gum, an anionic surfactant, a zwitterionic surfactant, a nonionic surfactant and a solvent, where the composition is substantially free of any organofluorine compounds. The galactomannan gum may be guar gum, the anionic surfactant may be an alkyl sulfate, the zwitterionic surfactant may be an alkyl iminodialkanoate, the nonionic detergent may be an alkyl polyglycoside and the solvent may be propylene glycol. The alkyl polyglycoside may be a $C_8$-$C_{10}$ alkyl polyglycoside with a 1.6 degree of polymerization.

In other embodiments, the high molecular weight polyacrylamidomethylpropane sulfonic acid is a 14-18 weight % solution with average molecular weight of about 2,000 kDa.

The concentrates may also contain components such as at least one biocide, at least one anti corrosion agent, and/or at least one electrolyte.

Also provided are firefighting foams, containing a concentrate as described above claim and water, and methods of making these foams, by foaming the concentrate water. The water may be, for example, fresh water, brackish water or salt water.

Methods of fighting a fire are provided, by foaming a concentrate as described above with water and applying the resulting foam to the fire. The fire may be fuelled, for example, by an organic liquid. The organic liquid may be a water-soluble organic liquid such as isopropanol or tetrahydrofuran.

DETAILED DESCRIPTION OF THE INVENTION

Aqueous firefighting composition concentrates are provided that contain an effective amount of a high molecular weight water soluble anionic acrylic polymer, an effective amount of at least one high molecular weight polysaccharide gum; and an effective amount of at least one surfactant. In the present context, a high molecular weight water-soluble anionic acrylic polymer is a polymer with a weight average molecular weight $M_w$ of at least one million (1000 kDa). The combination of the acrylic polymer and the gum provide a concentrate that generates foam with highly desirable firefighting properties, including foam expansion ratio, long burnback time, and slow drainage time, while avoiding problems with previous gum-containing foam concentrates, such as high viscosity and component separation upon storage.

The surfactant in the concentrate can be one or more fluorosurfactants, or combinations of surfactants including fluorosurfactants. The concentrates can also contain only non-fluorinated surfactants, providing a fluorine-free formulation that is surprisingly effective, has low viscosity, and does not cause problems with component separation upon prolonged storage. Advantageously, the concentrate is substantially free of fluorine-containing components and also is free of other halogen containing components. In the present context a composition is substantially free of a component when that component is present, if at all, at trace (impurity) levels that are too low to materially affect the properties of the composition.

Acrylic polymers previously have been used in foam concentrates, but at much lower molecular weights. For example, in WO 2011/050980, acrylic polymers with molecular weights of 100-200 kDa were used, but the resulting fluorine-free concentrates, although high-performing, experienced problems with separation upon prolonged storage. It has been found that increasing the molecular weight of the acrylic polymer to at least 1,000 kDa, and optionally up to at least 1,500 kDa or 2,000 kDa allows the preparation of concentrates that retain high performance while retaining low viscosity and component stability. Low viscosity is important to allow the concentrate to be pumped and accurately proportioned when used to prepare foams.

The components of the concentrates, including optional components, are described in detail below.

Acrylic Polymer Component

The concentrates described herein contain at least one high molecular weight anionic acrylic polymer. Acrylic polymers in the context herein are understood to mean polymers which are formed from ethylenically unsaturated monomers M and which comprise monomers derived from monoethylenically unsaturated $C_3$-$C_6$-monocarboxylic acids, for example monomers derived from methacrylic acid and acrylic acid. The monomers derived from acrylic acid include, aside from acrylic acid, all monomers which have at least one carboxyl group bonded to an ethylenically unsaturated double bond, for example methacrylic acid, maleic acid, fumaric acid, itaconic acid and/or citraconic acid. In addition to acrylic acid and the monomers derived from acrylic acid, the acrylic polymers may also comprise monomers in copolymerized form, which monomers are derivatives, especially esters, amides or anhydrides, of acrylic acid, or corresponding derivatives of the monomers derived from acrylic acid.

Suitable acrylic polymers which can be used are disclosed in EP 412389, EP 498634, EP-A-554 074, EP-A-1158 009, DE 3730885, DE 3926168, DE 3931039, DE 4402029, DE 10251141, DE 19810404, JP-A-56-81 320, JP-A-57-84 794, JP-A-57-185 308, U.S. Pat. Nos. 4,395,524, 4,414,370, 4,529,787, 4,546,160, 6,858,678, 6,355,727, WO 2006/122946 A1, WO 2006/134140, WO 2008/058921, WO 2009/019148 and WO 2009/0062994 and WO 2011/050980 which are incorporated by reference in their entireties.

The acrylic polymers are known or can be prepared using methods well-known in the art by free-radical polymerization of the ethylenically unsaturated monomers M. The polymerization can be effected by free-radical polymerization or by controlled free-radical polymerization processes. The polymerization can be performed using one or more initiators, and as a solution polymerization, as an emulsion polymerization, as a suspension polymerization or as a precipitation polymerization, or else in bulk. The polymerization can be performed as a batchwise reaction, or in semicontinuous or continuous mode.

The initiators used for the free-radical polymerization are customary free-radical-forming substances. Preference is given to initiators from the group of the azo compounds, the peroxide compounds and the hydroperoxide compounds. The peroxide compounds include, for example, acetyl peroxide, benzoyl peroxide, lauroyl peroxide, tert-butyl peroxyisobutyrate, caproyl peroxide. In addition to hydrogen peroxide, the hydroperoxides also include organic peroxides such as cumine hydroperoxide, tert-butyl hydroperoxide, tert-amyl hydroperoxide and the like. The azo compounds include, for example, 2-2'-azobisisobutyronitrile, 2,2'-azobis(2-methylbutyro-nitrile), 2,2'-azobis[2-methyl-N-(2-hydroxyethyl)-propionamide], 1,1'-azobis(1-cyclohexanecarbonitrile), 2,2'-azobis(2,4-dimethylvaleronitrile), 2,2'-azobis-(N,N'-dimethyleneisobutyroamidine). Particular preference is given to azobisisobutyronitrile (AIBN). The initiator is typically used in an amount of 0.02 to 5% by weight and especially 0.05 to 3% by weight, based on the amount of the monomers M, though it is also possible to use greater amounts, for example up to 30% by weight, for example in the case of hydrogen peroxide. The optimal amount of initiator naturally depends on the initiator system used and can be determined by the person skilled in the art in routine experiments.

The molecular weight of the acrylic polymers can be adjusted by addition of regulators in a small amount, for example 0.01 to 5% by weight, based on the polymerizing monomers M. Useful regulators include especially organic thio compounds, for example mercapto alcohols such as mercaptoethanol, mercaptocarboxylic acids such as thioglycolic acid, mercaptopropionic acid, alkyl mercaptans such as dodecyl mercaptan, and also allyl alcohols and aldehydes.

The anionic acrylic polymers typically are prepared by free-radical solution polymerization in an organic solvent or solvent mixture. Examples of organic solvents are alcohols, for example methanol, ethanol, n-propanol and isopropanol, dipolar aprotic solvents, for example N-alkyllactams such as N-methylpyrrolidone (NMP), N-ethylpyrrolidone, and also dimethyl sulfoxide (DMSO), N,N-dialkylamides of aliphatic carboxylic acids, such as N,N-dimethylformamide (DMF), N,N-dimethylacetamide, and also aromatic, aliphatic and cycloaliphatic hydrocarbons which may be halogenated, such as hexane, chlorobenzene, toluene or benzene, and mixtures thereof. Preferred solvents are isopropanol, methanol, toluene, DMF, NMP, DMSO and hexane, particular preference being given to isopropanol. In addition, the homo- and copolymers P can be prepared in a mixture of the above-described solvents and solvent mixtures with water. The water content of these mixtures is preferably less than 50% by volume and especially less than 10% by volume Optionally, the actual polymerization may be followed by a postpolymerization, for example by addition of a redox initiator system. The redox initiator systems consist of at least one, usually inorganic, reducing agent and an inorganic or organic oxidizing agent. The oxidation component comprises, for example, the aforementioned peroxide compounds. The reduction component comprises, for example, alkali metal salts of sulfurous acid, for example sodium sulfite, sodium hydrogensulfite, alkali metal salts of disulfurous acid such as sodium disulfite, bisulfite addition compounds of aliphatic aldehydes and ketones, such as acetone bisulfite, or reducing agents such as hydroxyl-methanesulfinic acid and salts thereof, or ascorbic acid. The redox initiator systems can be used with additional use of soluble metal compounds whose metallic components can occur in different valence states. Customary redox initiator systems are, for example, ascorbic acid/iron(II) sulfate/sodium peroxodisulfate, tert-butyl hydroperoxide/sodium disulfite, and tert-butyl hydroperoxide/sodium hydroxyl-methanesulfinate. The individual components, for example the reduction component, may also be mixtures, for example a mixture of the sodium salt of hydroxymethanesulfinic acid and sodium disulfite. The acrylic polymer is typically used in amounts of about 0.2 to about 2.5% by weight, more preferably about 0.5 to about 2.0% by weight and especially about 1.00 to about 1.75% by weight. It is also possible to use mixtures of acrylic polymers.

The acrylic polymer for use in accordance with the invention is typically used in amounts of 0.1 to 5% by weight and frequently in amounts of 2-4% by weight, based in each case on the total weight of the concentrate. It will be appreciated that it is also possible to use mixtures of acrylic polymers.

Advantageously, it has been found that high performance concentrates with low viscosity (suitable for pumping and proportioning) and high component stability (no component separation on storage) can be prepared using a commercially available polymer commonly used in the cosmetics industry. Poly-2-acrylamido-2-methyl-1-propane sulfonic acid (pAMPS) is available with an average molecular weight of 1.8-2 million; and use of this polymer permits preparation of fluorine-free foam concentrates that can achieve a triple 1A rating under the EN-1568 standard. This fluorine free concentrate provides a performance level comparable to that of a fluorine-containing foam concentrate. The concentrate can also be used with fluorosurfactants and other fluorine-containing components if desired. The pAMPS component advantageously is used at 3 wt % (calculated based on active polymer in an aqueous solution) although higher (up to 4, 5, or 6% and lower (down to 1 or 2%) concentrations may be used if desired Notably, use of pAMPS with a lower molecular weight (up to 800 kDa) did not provide acceptable performance, as described below.

Polysaccharide Gum Component

The concentrates also contain one or more high molecular weight polysaccharide gums. These gums are commonly used in fire foams used to fight fires fuelled by polar solvents because they precipitate from the foam upon contact with the solvent, providing a blanket that prevents mixing of the aqueous foam and the solvent. This provides high performance against fires fuelled by, for examples, alcohols and tetrahydrofuran, which are water-miscible.

Such gums also, however, typically cause foam concentrates to be highly viscous, causing problems with storage, transport, pumping and proportioning with water (or other diluent). The presence of the high molecular weight acrylic polymer described herein alleviates this problem to the degree that the concentrates have a viscosity sufficiently low to allow pumping and proportioning. Surprisingly, it also has been found that use of gum combinations allows use of lower amounts of gum without compromising performance, thereby also lowering the viscosity of the concentrates. Specifically, it has been found that a combination of a galactomannan gum, such as guar gum, and a xanthan gum is highly effective in lowering the amount of gum necessary to provide suitable performance. Alternatively, use of gum combinations allows use of higher amounts of gum without raising viscosity to an unacceptable or unusable level. Roughly equal amounts of each gum can be used, but the person of ordinary skill will recognize that the relative proportions of the gums can be varied to vary the properties of the concentrates.

The gum or gums is present typically in an amount of 0.2 to 7% by weight (total gum), advantageously 1 to 6% by weight or 2 to 5% by weight. In some concentrates, a combination of 2% galactomannan gum (such as guar gum) and 2% xanthan gum, has been found to be effective.

Gums that can be used include modified celluloses and modified starches, especially cellulose ethers such as methylcellulose, carboxymethylcellulose, hydroxyethylcellulose, hydroxypropylcellulose, methylhydroxypropylcellulose, methylhydroxyethyl-cellulose, natural polysaccharides such as xanthan, carrageenan, especially κ-carrageenan, λ-carrageenan or τ-carrageenan, alginates, guaran and agar, and also modified xanthan such as succinylglycan, or modified carrageenan. Xanthan and modified xanthan gums are commercially available under the trade names Keltrol® and Kelzan® from Kelco, for example the Keltrol® products Keltrol® CG, Keltrol® CG-F, Keltrol® CG-T, Keltrol® CG-BT, Keltrol® CG-SFT or Keltrol® RT, and the Kelzan® products Kelzan® T, Kelzan® ST, Kelzan® HP-T and Kelzan® ASX-T and Rhodopol®, e.g. the Rhodopol® products 23, 50MC, G, T and TG from Rhodia. Xanthan-based thickeners also are commercially available under the Keltrol® name.

Surfactant Component

The concentrates include at least one surfactant, present in an amount suitable to provide the desired foaming characteristics of the concentrate. The surfactant can be fluorinated or non-fluorinated and can be an anionic surfactant, a zwitterionic surfactant or a nonionic surfactant. Combinations of surfactants can be used, including multiple anionic surfactants, zwitterionic surfactants and nonionic surfactants. Advantageously, the concentrate contains at least one anionic surfactant, at least one zwitterionic surfactant and at least one nonionic surfactant. Exemplary surfactants are octyl sulphate (anionic), lauryl diproprionate (zwitterionic), and an alkyl polyglycoside (non-ionic). The alkyl polyglycoside can be, for example, a $C_8$-$C_{10}$ alkyl polyglycoside with a 1.6 degree of polymerization. The surfactant or surfactants are used in concentrations of 1-25% (total surfactant wt %). A typical surfactant combination is 1-10 wt % anionic surfactant, 5-20 wt % alkylpolyglycoside, and 5-25 wt % zwitterionic surfactant. An exemplary combination is 5-8 wt % octyl sulfate, 10-25 wt % lauryl dipropionate and 6-11 wt % $C_8$-$C_{10}$ alkyl polyglycoside with a 1.6 degree of polymerization Suitable surfactants, especially anionic and nonionic surfactants, are well known to those skilled in the art and can be purchased commercially. Suitable anionic surfactants are especially $C_8$-$C_{20}$-alkyl sulfates, i.e. sulfuric monoesters of $C_8$-$C_{20}$-alkanols, e.g. octyl sulfate, 2-ethylhexyl sulfate, decyl sulfate, lauryl sulfate, myristyl sulfate, cetyl sulfate and stearyl sulfate, and salts thereof, especially the ammonium, substituted ammonium and alkali metal salts thereof, and also $C_8$-$C_{20}$-alkyl ether sulfates, i.e. sulfuric monoesters of $C_2$-$C_4$-alkoxylated $C_8$-$C_{20}$-alkanols, especially sulfuric monoesters of ethoxylated $C_8$-$C_{20}$-alkanols and salts thereof, especially the ammonium, substituted ammonium and alkali metal salts thereof, where the degree of alkoxylation (or degree of ethoxylation), i.e. the number of $C_2$-$C_4$-alkylene oxide repeat units (or ethylene oxide repeat units) is generally in the range from 1 to 100 and especially in the range from 2 to 20. Examples of $C_8$-$C_{20}$-alkyl ether sulfates are the sulfuric monoesters of ethoxylated n-octanol, of ethoxylated 2-ethylhexanol, of ethoxylated decanol, of ethoxylated lauryl alcohol, of ethoxylated myristyl alcohol, of ethoxylated cetyl alcohol and of ethoxylated stearyl alcohol. The concentrate preferably comprises a mixture of at least 2, for example 2 or 3, anionic surfactants with different carbon numbers.

Suitable anionic surfactants are especially surfactants based on the sodium salt of octyl sulfate and triethanolammonium salts of fatty alcohol sulfates, preferably a mixture of lauryl sulfate and myristyl sulfate, components which are commercially available under the names Texapon 842 and Hansanol AS 240T. Further suitable commercially available products are Sulfethal 40/69 and Sabosol C8.

Examples of nonionic surfactants are alkyl polyglucosides, especially alkyl polyglucosides having 6 to 14 carbon atoms in the alkyl radical, for example the commercial product Glucopon 215 UP from Cognis, or the C9/C11-alkyl polyglucoside sold under the trade name APG325n from Cognis. The chemical nature of these surfactants for use in accordance with the invention is not critical, but preference is given to using materials which are based on renewable raw materials and/or are biodegradable Zwitterionic (amphoteric) surfactants have both cationic and anionic centers attached to the same molecule. The cationic moiety typically is an ammonium group, including primary, secondary, or tertiary amines or quaternary ammonium cations. The anionic moiety can be, for example, sulfates, sulfonates, sultaines and phosphates. Zwitterionic detergents are well known in the art and include sodium N-lauryl-β-iminodipropionate, commonly referred to as lauryl dipropionate. Zwitterionic surfactants also include, but are not limited to, those which contain in the same molecule, amino and carboxy, sulfonic, and sulfuric ester moieties and the like. Higher alkyl ($C_6$-$C_{14}$) betaines and sulfobetaines are included in this category. Commercially available products include Chembetaine CAS (Lubrizol Inc.) and Mirataine CS (Rhodia), both sulfobetaines, and Deriphat 160C (BASF), a C12 amino-dicarboxylate.

Where fluorosurfactants are used, the surfactants are typically single perfluoro-tail molecules and may have multiple hydrophilic heads. Advantageously, the fluorochemical surfactant contains perfluoroalkyl groups no longer than $C_6$, although $C_8$ and longer fluorosurfactants can also be used. Examples of suitable fluorochemical surfactants include those described in WO/2012/045080.

Other Components

The concentrate may contain additional components to provide further desirable properties. These optional components include:

Solvent

The concentrate may contain a solvent component that enhances solubility of one or more of the components in the mixture. Typical solvents include glycol ethers, such as diethylene glycol monoethyl ether (butyl carbitol), glycols, such as 1,2-propylene glycol and/or ethylene glycol, and also mixtures of solvents. Organic solvents typically are used in an amount of 5 to 20% by weight, more preferably 10 to 20% by weight and especially 12 to 15% by weight. Variation of this component of the composition also enables the frost resistance of the composition to be adjusted, as may be required, for example, for foam concentrates that are stored in cold climates.

Foam Aids

Foam aids may be used to enhance foam expansion and drain properties, while providing solubilization and anti-freeze action. Useful foam aids are well known in the art and are disclosed, for example, in U.S. Pat. Nos. 5,616,273, 3,457,172; 3,422,011 and 3,579,446, which are herein incorporated by reference.

Typical foam aids include alcohols or ethers such as ethylene glycol monoalkyl ethers, diethylene glycol monoalkyl ethers, propylene glycol monoalkyl ethers, dipropylene glycol monoalkyl ethers, triethylene glycol monoalkyl ethers, 1-butoxyethoxy-2-propanol, glycerine, and hexylene glycol.

Freeze Protection Package

A freeze protection package is used to prevent the concentrate freezing or becoming unusably viscous at low temperatures. Typical components include glycerine, ethylene glycol, diethylene glycol, and propylene glycol. Other potential components include salts and other solids which reduce the freezing point of the concentrate, such as calcium, potassium, sodium and ammonium chloride and urea.

Sequestering, Buffer, and Corrosion Package

The components of the sequestering, buffer, and corrosion package, include agents that sequester and chelate metal ions. Examples include polyaminopolycarboxylic acids, ethylenediaminetetraacetic acid, citric acid, tartaric acid, nitrilotriacetic acid, hydroxyethylethylenediaminetriacetic acid and salts thereof. Buffers are exemplified by Sorensen's phosphate or McIlvaine's citrate buffers. The nature of the corrosion inhibitors is limited only by compatibility with other formula components. Typical corrosion inhibitors include ortho-phenylphenol, toluyl triazole, and many phosphate ester acids.

Antimicrobials and Preservatives

These components may be used to prevent biological decomposition of natural product based polymers incorporated as polymeric film formers. Examples include Kathon CG/ICP (Rohm & Haas Company) and Givgard G-4 40 (Givaudan, Inc.), and are disclosed in U.S. Pat. No. 5,207,932, which is herein incorporated by reference. Additional preservatives are disclosed in U.S. Pat. Nos. 3,957,657; 4,060,132; 4,060,489; 4,306,979; 4,387,032; 4,420,434; 4,424,133; 4,464,267, 5,218,021, and 5,750,043.

Electrolytes

Electrolytes may be added to concentrates to balance the performance of the concentrate when proportioned with water ranging from soft to very hard, including sea water or brine, and to improve agent performance in very soft water. Typical electrolytes include salts of monovalent or polyvalent metals of Groups 1, 2, or 3, or organic bases. The alkali metals particularly useful are sodium, potassium, and lithium, or the alkaline earth metals, especially magnesium, calcium, and zinc or aluminum. Organic bases might include ammonium, trialkylammonium, bis-ammonium salts or the like. The anions of the electrolyte are not critical, except that halides may not be desirable due to metal corrosion. Sulfates, bisulfates, phosphates, nitrates and the like are commonly used. Examples of polyvalent salts include magnesium sulfate and magnesium nitrate.

Exemplary Formulations

The formulations described below are exemplary only, and are not limiting of the concentrates described herein. An advantageous concentrate contains an effective amount of high molecular weight polyacrylamidomethylpropane sulfonic acid, a galactomannan gum, a xanthan gum, an anionic surfactant, a zwitterionic surfactant, a nonionic surfactant and a solvent, where the composition is substantially free of any organofluorine compounds. The galactomannan gum may be guar gum, the anionic surfactant may be an alkyl sulfate, the zwitterionic surfactant may be an alkyl iminodialkanoate, the nonionic detergent may be an alkyl polyglycoside and the solvent may be propylene glycol. The alkyl polyglycoside may be a $C_8$-$C_{10}$ alkyl polyglyco side with a 1.6 degree of polymerization. The high molecular weight polyacrylamidomethylpropane sulfonic acid may be a 14-18 weight % solution with average molecular weight of about 2,000 kDa.

The concentrates may be produced at any suitable strength, including, but not limited to, 1, 3 and 6% (w/w) foam concentrates, which are concentrations that are typical for commercial use. Concentrates that are less than 1% (w/w) or greater than 6% (w/w) also may be prepared. As used herein, the lowest numbered strength for the concentrate used indicates the most concentrated product, i.e., the percent designation refers to the proportioning rate of foam concentrate to water. Accordingly, one part of 1% concentrate used with 99 parts water gives 100 parts of use strength pre-mix; similarly, three parts 3% concentrate and 97 parts water gives 100 parts of pre-mix. As used herein, the term "water" may include pure, deionized or distilled water, tap or fresh water, sea water, brine, or an aqueous or water-containing solution or mixture capable of serving as a water component for the fire fighting composition.

Use of the Concentrates

The compositions described herein are useful for preparing foams that can be used for fighting fires in a wide variety of situations, and on a large or small scale, for example forest fires, building fires and the like. The foams are particularly useful for fighting fires caused or fueled by highly flammable industrial liquids, such as petrochemicals, organic solvents, and intermediates or monomers used in polymer synthesis. In particular the foams may be effectively used to suppress and/or extinguish fires where the burning material contains volatile fuels and/or solvents. Examples include, but are not limited to: hydrocarbons and hydrocarbon mixtures such as gasoline, pentane, hexane and the like; alcohols, such as methanol, ethanol, isopropanol and the like; ketones such as acetone, methyl ethyl ketone and the like; ethers, including cyclic ethers, such as diethyl ether, methyl t-butyl ether, ethyl t-butyl ether, tetrahydrofuran and the like; esters, such as ethyl acetate, propyl acetate, ethyl propionate and the like; oxiranes, such as propylene oxide, butylene oxide and the like; and mixtures of one or more of these materials. The skilled artisan will appreciate that this list is merely illustrative and non-limiting.

Methods for fighting fires also are provided, especially for fighting fires of organic liquids or for fighting solids fires. For this purpose, the concentrate will be diluted with water, or added to the extinguishing water in the desired amount, for example in the amounts specified above, and the diluted composition will be foamed by means of suitable equipment to give a foam extinguishant. In general, the equipment is that known for use for production of extinguishing foams. Such equipment generally comprises a means of generating the foam, for example foam nozzles for heavy or medium foam, or foam generators, the principle of which is generally based on mixing of the aqueous diluted concentrate with air in a suitable manner to give a foam. In the case of foam nozzles, the aqueous diluted concentrate is fed through a nozzle at high speed into a tube with orifices for ingress of air, which are arranged close to the nozzle, as a result of which air is sucked in and forms a foam. The extinguishing foam thus generated is applied in a manner known per se to the seat of fire or to sites which are to be protected from a fire. The diluted composition is generally obtained in situ, i.e. the concentrate is fed continuously to the extinguishing water during the extinguishment operation, generally by means of so-called inductors, for example inline inductors, injector inductors, pump inductors or bladder tank inductors, which supply the amount of concentrate needed for foam production to the extinguishing water stream or to a portion of the extinguishing water stream.

The foams obtainable from the concentrates are also suitable for covering volatile organic substances, for example organic liquids, e.g. volatile organic chemicals, which have been released into the environment in liquid form in the event of an accident or in some other way. The covering of such substances is possible in a simple manner, by applying a foam over an area, i.e. as a foam blanket, onto the surface of the organic volatile substances, for example an escaped liquid, and in this way covering it. In this way, it is possible to effectively prevent vaporization of the organic substance with the concentrates.

Example 1

An exemplary concentrate was prepared using the following components, and tested for extinguishing performance:

| | |
|---|---|
| xanthan gum | 2% |
| guar gum | 2% |
| propylene glycol | 14% |
| octyl sulfate | 7% |
| lauryl dipropionate | 20% |
| C8-C10 APG 1.6 degree of polymerization | 10% |
| 15 wt % solution of polyacrylamidomethylpropane sulfonic acid | 20% |
| water | 25% |

This concentrate was used to prepare foam that was then assessed in standard UL 162 tests against fires fuelled by heptane, acetone, isopropanol, and provided performance that met the highest level of the test and that was comparable to conventional fluorine-containing concentrates. By comparison, when a lower molecular weight acrylic polymer (30% of a 10 wt % solution, $M_w$ 800 kDa was used, the concentrate failed to extinguish the fires and failed the tests.

What is claimed is:

1. An aqueous firefighting foam concentrate comprising:

0.1% to 18% by weight of a water soluble anionic acrylic polymer having an average molecular weight of 1000 to 2000 kDa;

0.2 to 7% by weight of at least two types of polysaccharide gums in total; and 1 to 25% by weight of at least one surfactant.

2. The concentrate according to claim 1 wherein said surfactant is a non-fluorinated surfactant and said composition is substantially free of any organofluorine compounds.

3. The concentrate according to claim 1, wherein said polymer is a polyacrylamidomethylpropane sulfonic acid having an average molecular weight of about 1,800 to 2000 kDa.

4. The concentrate according to claim 3, wherein the concentrate comprises about 2% by weight of a galactomannan gum and about 2% by weight of a xanthan gum.

5. The concentrate according to claim 1, wherein said polymer is polyacrylamidomethylpropane sulfonic acid.

6. The concentrate according to claim 1, further comprising a solvent.

7. The concentrate according to claim 6 wherein said solvent is selected from the group consisting of propylene glycol, ethylene glycol, and butylcarbitol.

8. The concentrate according to claim 1, wherein one of said polysaccharide gums is a galactomannan gum.

9. The concentrate according to claim 1, wherein one of said polysaccharide gums is a xanthan gum.

10. The concentrate according to claim 1, comprising at least one galactomannan gum and at least one xanthan gum.

11. The concentrate according to claim 1, wherein said at least one surfactant is selected from the group consisting of anionic surfactants, zwitterionic surfactants and nonionic surfactants.

12. A firefighting foam comprising a concentrate according to claim 1 and water.

13. An aqueous firefighting foam concentrate comprising:

1 to 5 wt. % of a water soluble polyacrylamidomethylpropane sulfonic acid having an average molecular weight of 1000 to 2000 kDa;

2 to 5 wt. % polysaccharide gum, which includes galactomannan gum and xanthan gum;

1-10 wt % anionic surfactant;

5-20 wt % alkylpolyglycoside surfactant; and 5-25 wt % zwitterionic surfactant.

14. The concentrate of claim 13, wherein the anionic surfactant comprises alkyl sulfate; the zwitterionic surfactant comprises alkyl iminodialkanoate; and the alkylpolyglycoside surfactant, comprises $C_8$-$C_{10}$ alkyl polyglycoside.

15. The concentrate of claim 13, wherein the concentrate further solvent selected from the group consisting of comprises glycols, glycol ethers and combinations thereof.

16. The concentrate of claim 15, wherein the concentrate comprises solvent selected from the group consisting of diethylene glycol monoethyl ether, propylene glycol, ethylene glycol, and/or butylcarbitol.

17. The concentrate of claim 13, wherein the polyacrylamidomethylpropane sulfonic acid has an average molecular weight of at least about 1,500 kDa.

18. The concentrate of claim 13, wherein the concentrate comprises about 2 wt. % of the galactomannan gum and about 2 wt. % of the xanthan gum.

19. The concentrate of claim 13, comprising 2 to 4 wt. % of the water soluble polyacrylamidomethylpropane sulfonic acid, which has an average molecular weight of at least 1500 kDa.

20. An aqueous firefighting foam concentrate comprising:

1 to 5 wt. % of a water soluble polyacrylamidomethylpropane sulfonic acid having an average molecular weight of at least about 1500 kDa;

2 to 5 wt. % polysaccharide gum, which includes at least one galactomannan gum and at least one xanthan gum;

1-10 wt % anionic surfactant, which comprises alkyl sulfate;

5-20 wt % alkylpolyglycoside surfactant;

5-25 wt % zwitterionic surfactant, which comprises alkyl iminodialkanoate; and 5-20 wt % solvent selected from the group consisting of diethylene glycol monoethyl ether, propylene glycol, ethylene glycol, and/or butylcarbitol.

* * * * *